US010689184B2

(12) United States Patent
Shah

(10) Patent No.: US 10,689,184 B2
(45) Date of Patent: Jun. 23, 2020

(54) WRIST-MOUNTED PRESSURIZED FLUID SHOOTER

(71) Applicant: Jayesh Shah, Shohola, PA (US)

(72) Inventor: Jayesh Shah, Shohola, PA (US)

( * ) Notice: Subject to any disclaimer, the term of this patent is extended or adjusted under 35 U.S.C. 154(b) by 557 days.

(21) Appl. No.: 14/866,959

(22) Filed: Sep. 27, 2015

(65) Prior Publication Data

US 2017/0088340 A1 Mar. 30, 2017

(51) Int. Cl.

| | |
|---|---|
| ***B65D 83/66*** | (2006.01) |
| ***B65D 83/48*** | (2006.01) |
| ***B65D 83/14*** | (2006.01) |
| ***B65D 83/20*** | (2006.01) |
| ***B65D 83/38*** | (2006.01) |

(52) U.S. Cl.

CPC ..... *B65D 83/66* (2013.01); *B65D 83/201* (2013.01); *B65D 83/388* (2013.01); *B65D 83/48* (2013.01); *B65D 83/752* (2013.01); *B65D 83/756* (2013.01)

(58) Field of Classification Search

CPC .... B65D 83/66; B65D 83/201; B65D 83/388; B65D 83/48; B65D 83/752; B65D 83/756

USPC ..... 239/1, 152, 154, 333, 337, 373; 222/79, 222/175, 209, 399; 446/475

See application file for complete search history.

(56) References Cited

U.S. PATENT DOCUMENTS 5,484,085 A * 1/1996 Bennett ..... F41H 9/10 239/154
5,503,304 A * 4/1996 Keller ..... F41H 9/10 222/175
6,814,260 B2 * 11/2004 Caffrey ..... B05B 9/0811 446/475

* cited by examiner

*Primary Examiner* — Steven J Ganey

(57) ABSTRACT

A wrist mounted toy is described wherein a pressurized canister containing a string foam compound, or other pressurizable liquid with mid to low viscosity, is attached to a vessel containing a check valve. A geared-trigger mechanism allows for the user to expel the fluid at a pressure and rate dependent on the pressure he or she places on the lever. Additionally, the actions of removing and replacing the air and fluid canisters provide the user with a more interactive experience compared to a simple load and shoot toy. Many variations can be adapted to the toy to allow for a wide range of uses. The toy allows the user to enjoy a device which resembles the Marvel character's shooter more closely and discharge the fluid to quite a distance.

12 Claims, 3 Drawing Sheets

WRIST-MOUNTED PRESSURIZED FLUID SHOOTER

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISC APPENDIX

Not Applicable

BACKGROUND OF THE INVENTION

1. Field of the Invention

The present invention lies within the field of wearable toys which discharges pressurized fluid through the use of a lever resting on the user's palm.

2. Background of the Invention

A large variety of shooting toys currently exist. These shooting toys discharge a variety of elements and appear in many different shapes and sizes. Of these toys, many are known to include the use of shooting fluids via pressurized canisters, and some of which discharge string foam through a wrist mounted apparatus. These toys provide fun and amusement for all ages.

Over the last several years, many features have been added to these toys to allow for further amusement. Such features include the use of several different projectile elements on one rotatable wrist harness, silly string canisters, electronic motors and pumps, highly pressurized canisters, and concealable reservoirs. The rotatable wrist harness allows for the use of many different projectiles to be utilized at the user's discretion. However, this invention limits the ability of string foam to be shot at a long distance. Additionally, the large size limits its use as a concealable toy. Silly string canisters attached to a wrist mounted actuator provide an enjoyable experience. However, its large size also prevents it from being used as a concealable toy. The silly string, meant to be used outdoors, also succumbs heavily to winds, thereby preventing it from traveling to a suitable distance. Electronic motors and pumps allow the string foam to be shot over a longer distance and do not require much labor on the user's end. Nevertheless, electronic components require batteries and a larger amount of space, and in most cases, many of the electronic parts have not become small enough to withstand such large pressures and demands, and still provide its intended function. Also the added cost of replacing batteries in addition to fluid canisters could be a deterrent from this being a repeatedly used toy. Highly pressurized canisters, or air compressors, are more likely to be employed by adults. Pressurized canisters propel the string foam a great distance and minimize the use of space directly on the wrist. The dangers of pressurized containers can be a negative factor for many when deciding whether or not to purchase the toy. Additionally, the use of air compressors would prevent the toy from being portable. Concealable reservoirs allow for the user to utilize the toy without others being aware that he or she is wearing it. The reservoirs can be concealed in a number of different ways, such as a belt, backpack, arm-cuff, or leg-cuff. However, the reservoir would need to be pressurized in order to maintain its concealable feature where an actuator is simply present in the palm of the user's hand. This may pose a health and safety hazard, and prevent the size of the reservoir from being kept to a minimum. Therefore, the reservoir would become more evident to others.

All the previously-mentioned shooting toys provide several beneficial features which helped advance the shooting toy field. Nevertheless, it would be desirable to provide a toy which would include most of the features and address the shortcomings of the aforementioned toys.

BRIEF SUMMARY OF THE INVENTION

The present invention will help to address the shortcomings of the previously-mentioned toys and include many of the features. The smaller size of the toy will allow for the concealable feature to be maintained. Two versions of this toy will be mentioned, here. One will be a version more suitable for children. The other will be more suitable for adults. Both will contain similar internal mechanisms of action, but differences will be noted in shape, size, pressure, and some portions of the internal mechanics.

The children's version consists of 4 parts: 1) Pressurized Air Housing comprising a Pressurized Air Canister, 2) Fluid Canister, 3) Valve Vessel with Lever, and an 4) Outer Housing with Wrist Straps. The wrist straps are hook-and-loop straps that the user places around their wrist to retain the apparatus. The pressurized canister contains the compressible air (i.e. Air or CO2). The fluid canister contains a rubber piston which advances the fluid into the valve vessel with the aid of the pressurized air. The valve vessel contains a check valve which stops the flow of the fluid until the user depresses the lever to allow it to escape into a single stream.

The adult version consists of 4 parts: 1) Pressurized Air Housing comprising a CO2 Cartridge Housing, 2) Fluid Canister, 3) Valve Vessel with Lever, and an 4) Outer Housing with Wrist Straps. The hook-and-loop straps are used to retain the apparatus around the user's wrist. The 12 g Carbon Dioxide cartridge housing is meant to intake a 12 g CO2 cartridge typically used for paintball and BB guns. The fluid canisters contain the compressible fluid (i.e. silly string) and a moving piston, which is advanced by the CO2. The valve vessel contains a check valve and is similar to that found in the children's version noted above.

The present invention can embody several variations. The external appearance can be modified to fit the user's preference. The current toy is shown in a bracelet-style housing. This is done for ease of handling and greater availability of interior space. However, the housing shape and size can be modified to fit the user's preference. For example, the CO2 housing found in the adult version may also be made to fit larger sized cartridges, although this will increase the dimensions of the apparatus, or the fluid canister can be made to fit a collapsible bag containing the fluid instead of utilizing the piston.

Another variation can be made to the valve. The current check valve is used for its small size, high pressure rating, and ability to dispense viscous fluids. The valve can be substituted for other valves, which may hold a greater reservoir volume and withstand higher pressure. Nevertheless, to maintain the concealable nature of the toy, a small valve with the ability to repeatedly dispense a highly pressurized and viscous fluid in a singular stream is preferred.

Another variation is to include a highly pressurized fluid canister in the adult version, therefore eliminating the need for a CO2 cartridge housing, and increasing fluid volume and usage time.

BRIEF DESCRIPTION OF THE SEVERAL VIEWS OF THE DRAWING

Below are brief descriptions of the included illustrations, using the bracelet-style housing variation of the present toy.

DETAILED DESCRIPTION OF THE INVENTION

The following is a detailed description of the present invention to allow those skilled in manufacturing such products to understand and create the toy, and include any variations apparent to them that fall within the scope of the present toy.

Figure 1:
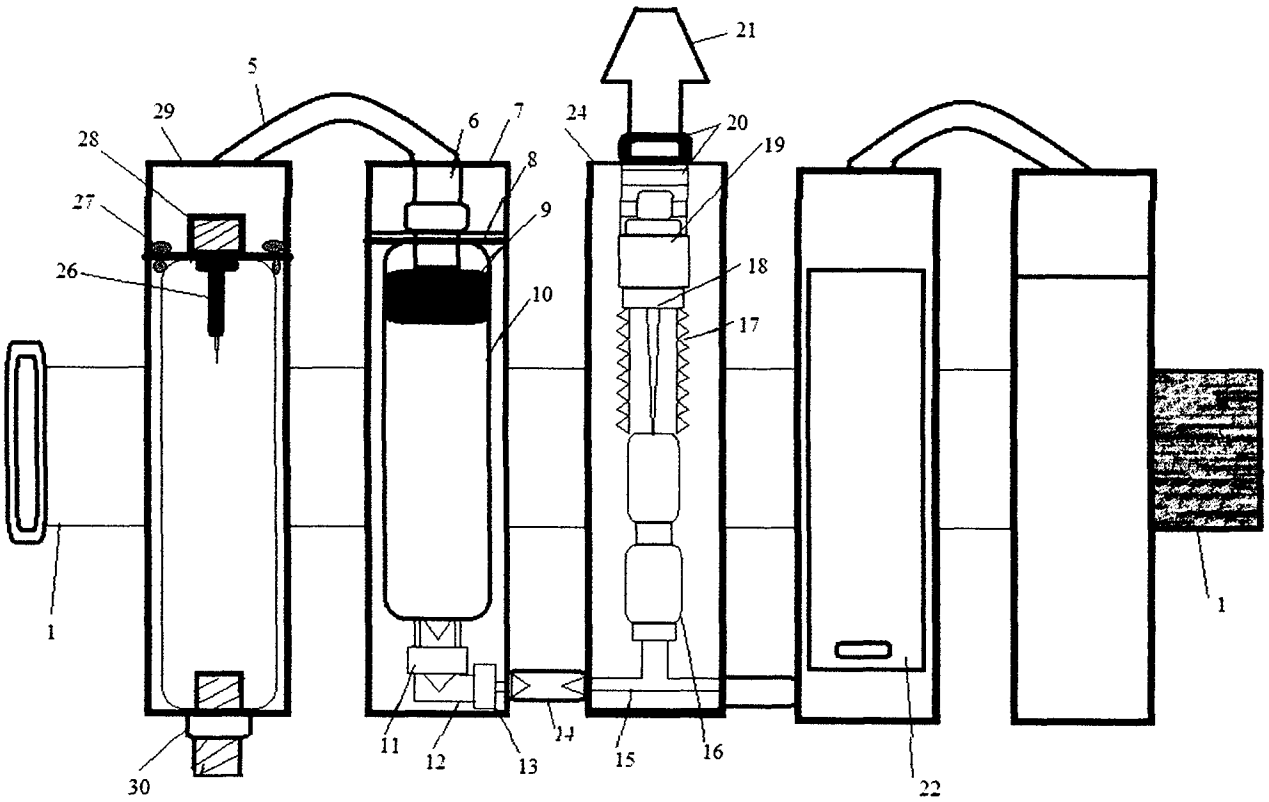
FIG. 1 depicts the children's version of the toy's exterior and interior in an overhead view. The child version has a cartridge with a Schrader valve that can be pressurized with air, and then inserted into the housing to use.
Figure 3:
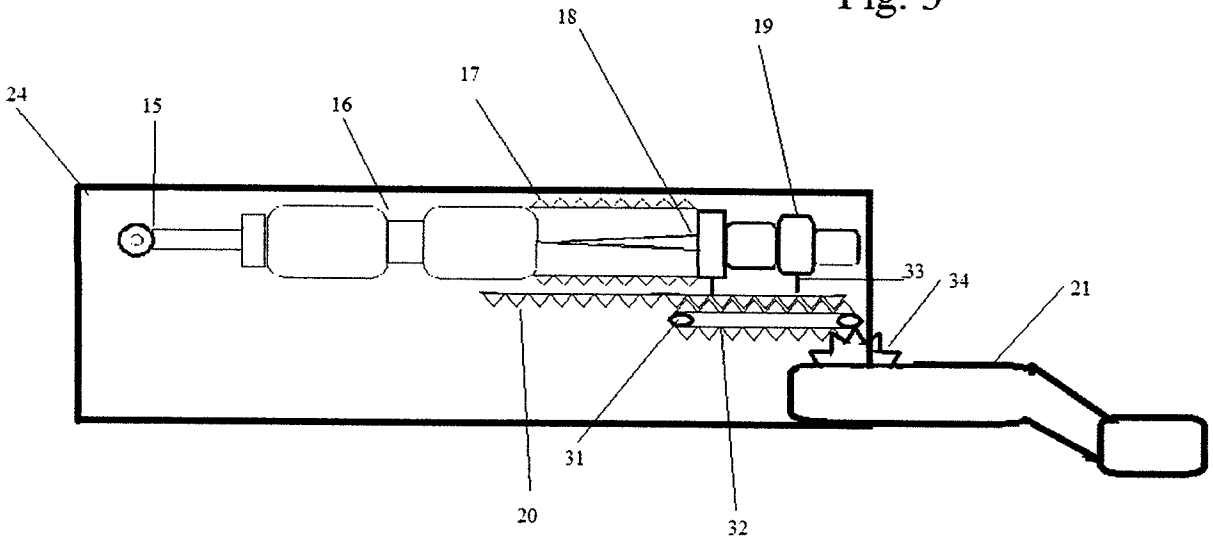
FIG. 3 depicts the toy's valve vessel and lever mechanism in the side view. The vessel is the same in both the child and adult version, and allows the user to press the lever, thereby pushing the needle towards the check valve and allowing the fluid to escape through the spray nozzle.

The children's version, as shown in FIG. 1 and FIG. 3, consists of 4 parts: 1) Pressurized Air Housing comprising a Pressurized Air Canister 29, 2) Fluid Canister 10, 3) Valve Vessel 24 with Lever 21, and an 4) Outer Housing 7 with Wrist Straps 1. The wrist straps 1 are hook-and-loop straps that the user places around their wrist to retain the apparatus. The pressurized canister 29 is filled with air or carbon dioxide to no more than 140 psi via a Schrader valve 30, which is post-sealed, at the rear of the canister 29. The canister 29 has an opening at the front end which is sealed using a solid rubber valve 26, typically seen in basketballs. When the user connects the canister 29 to the outer housing, magnets 27 in both parts attract each other to hold the two parts together. An inflation needle 28 in the outer housing inserts into the rubber valve 26 when the user inserts the canister 29. The inflation needle 28 allows the air to escape the canister 29 and enter the fluid canister 10 via air tubing 5 and Schrader valve 6, but does not proceed any further due to the piston 9. When the user depresses the lever 21 attached to the valve vessel 24, the air advances the piston 9, thereby pushing the fluid out though the spray nozzle 19 located within the valve vessel 24. The fluid canister 10 has a female to male luer lock check valve 11 attached to the front end, which prevents the fluid from leaking when the user is handling the canister 10. The valve 11 attaches to the outer housing via a female luer lock elbow 12. The rear end of the canister attaches to the housing via a slot 8 in the housing, and is air-tight because of a rubber O-ring affixed to the canister's 10 outer rim. When the user opens an outer housing cover 22 and properly inserts the fluid canister 10 and depresses the lever 21, the fluid escapes the canister 10 and traverses a short span of fluid tubing 14, which is attached to the elbow 12 via luer to barbed fitting 13 to enter the valve vessel 24 via barbed to NPT tee fitting 15. Upon entering the valve vessel 24, the fluid halts at a small check valve oriented in reverse. The lever 21, when depressed, results in the geared-trigger mechanism 20, 31, 32, 33, 34 advancing the spray nozzle 19 and the attached needle 18 towards the small check valve. The needle 18 pushes the small check valve open and allows the fluid to enter the needle's 18 cavity and exit through the nozzle 19. The needle is covered in a rubber bellows 17 to prevent fluid from entering anything but the needle 18 cavity, and allow a spring-back motion to aid the geared-trigger mechanism 20, 31, 32, 33, 34 in returning to the closed position. The lever 21 is attached to the front of the gear 34, and when depressed, causes the gear 34 to rotate forward. The gear 34, when rotating forward, results in the belt 32 moving in a counter-clockwise fashion around two spring-loaded bearings 31 when viewed from the side depicted in FIG. 3. There are two rods 33 which are permanently attached between the spray nozzle 19 and the to portion of the belt 20. As the belt 32 moves counter-clockwise, the rods 33 and belt 20 travel towards the rear of the vessel 24, along with the spray nozzle 19 and needle 18, and the rubber bellows 17 becomes compressed as the needle 18 opens the small check valve and releases the fluid. When the user releases the lever 21, the rubber bellows 17 expands and returns the needle 18, spray valve 19, belt 20, 32, and gear 34 to its starting position, and closes the small check valve. When the user exhausts the fluid, the canister 10 can be removed by opening the outer housing cover 22 and reversing the actions used to insert the canister 10. Air will be expelled when removing the canister 10, but due to the small size of the canister 10, the pressure of the air will be minimal and will not pose any hazards to the user. The air-pressure canister 29 can also be replaced by reversing the actions used to insert the canister 29. The air pressure canister 29 should be removed prior to removing the fluid canister 10.

The manufacture of the children's version of the present toy should take into account the materials being used. It is advantageous to maintain minimal dimensions of the toy, while still maintaining appropriate pressure ratings.

Figure 2:
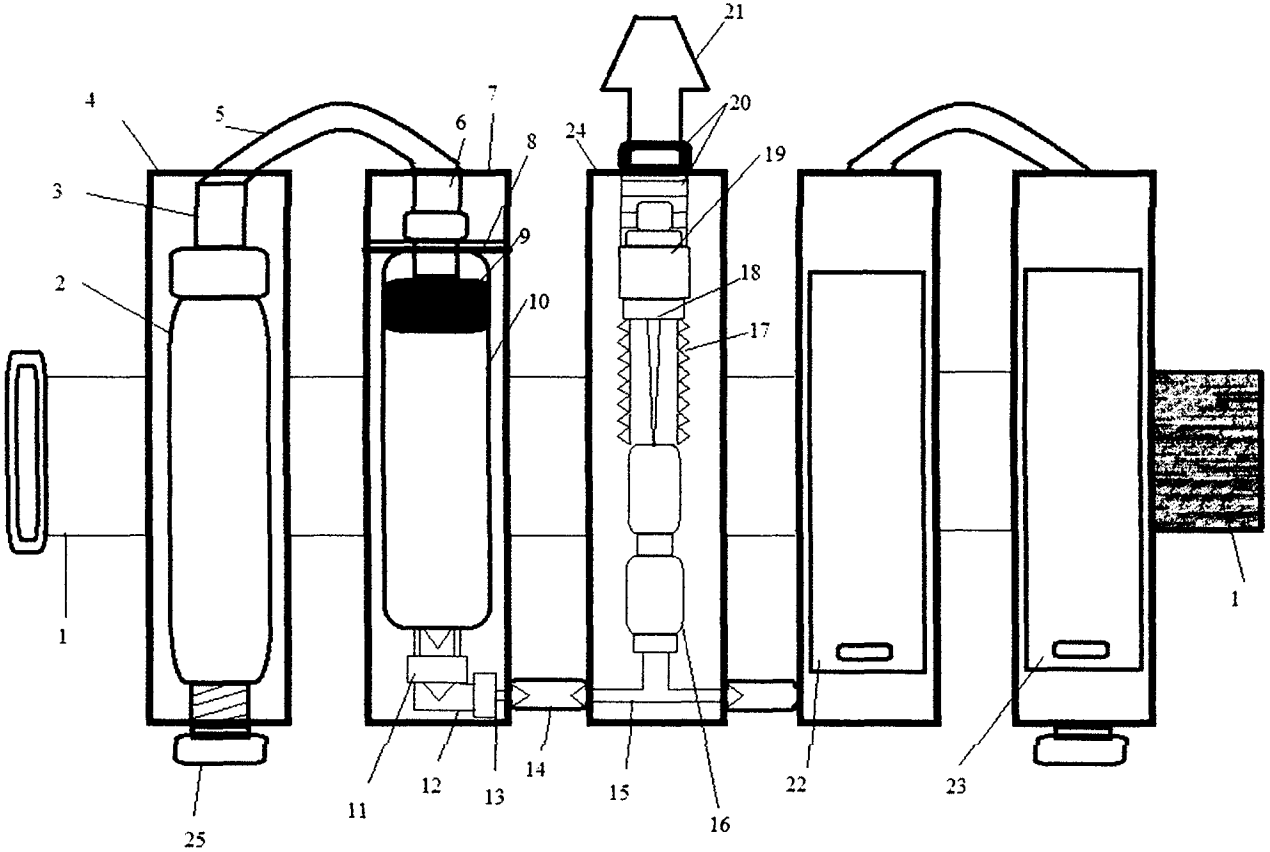
FIG. 2 depicts the adult version of the toy's exterior and interior in an overhead view. The adult version has a housing compartment for a CO2 cartridge where the seal is punctured using a needle, and the pressurized CO2 is available for use.

The adult version, as shown in FIG. 2 and FIG. 3, consists of 4 parts: 1) Pressurized Air Housing comprising a 12 g CO2 Cartridge Housing 4, 2) Fluid Canister 10, 3) Valve Vessel 24 with Lever 21, and 4) Hook-and-Loop Straps 1. The hook-and-loop straps 1 are attached to the underside of each part, and are also used to retain the apparatus around the user's wrist. The 12 g Carbon Dioxide cartridge housing 4 is meant to intake a 12 g CO2 cartridge 2 typically used for paintball and BB guns. The user inserts the CO2 cartridge 2 by opening a CO2 cartridge housing cover 23 and placing the cartridge 2 inside. The neck of the cartridge 2 is screwed into the orifice containing the piercing needle 3 by rotating the bolt 25 at the rear of the cartridge housing. The piercing needle 3 is also an open/close valve 3, which could halt the flow of CO2 to the fluid canister 10. When the cartridge 2 seal is punctured, CO2 escapes and enters the outer housing 7. The CO2 traverses a short span of air tubing 5 to enter the Schrader valve 6 located in the portion of the outer housing 7 behind the fluid canister 10. The CO2 opens the valve 6 and enters the fluid canister 10, but does not proceed beyond the piston 9. When the user depresses the lever 21, the pressure difference allows the CO2 to push the piston 9 forward, and expel the fluid from the canister 10. At this juncture, the adult version of the toy is similar to the children's version. The fluid will travel further than the children's version due to the higher pressures. Due to these higher pressures, the outer housing 7 must retain a high pressure rating to avoid damage to the toy and injury to the user, as well as an acceptable working temperature since the CO2 draws heat away from the materials it comes into contact with. When removing the fluid canister 10, the user should turn the piercing needle 3 to the closed position, and then remove the fluid canister 10. The user should not remove the CO2 cartridge 2 until it is completely exhausted, which will become evident when the user presses the lever 21 and fluid is not expelled at the proper pressure and distance.

Manufacturing difficulties arise when attempting to utilize small materials while maintaining high pressure ratings and air/water-tight seals. Luer-lock fittings arrive closest to achieving the aforementioned requirements. Widely used in the medical industry, luer-lock fittings provide small dimensions with quick and easy connectivity. In addition, tight seals are achieved. Although the pressure ratings are not ideal, the fittings can be retrofitted with another material to assist with pressure ratings and avoid damaging the fitting.

The present toy is distinguished from previous toys of the same field in that it maintains a smaller size, allows for the fluid to be shot a further distance, succumbs less to heavy winds due to the higher pressure in the canister and the longer travel length through the nozzle, and a more closely related version of the device used by the Marvel Comics character.

The invention claimed is:

1. A fluid-shooting toy, comprising:
an outer housing;
a check valve vessel;
a lever attached to a geared-triggered system;
a fluid-filled canister;
a pressurized air housing;
wherein the check valve vessel, which is connected to the fluid-filled canister, comprises:
a small check valve, normally in the closed position;
a tee fitting attached to the small check valve on an inlet side;
a rubber bellows attached to the small check valve on an outlet side;
and a spray nozzle attached to the rubber bellows; wherein the spray nozzle, cheek valve vessel, and lever are connected via the geared-triggered system.

2. The toy according to claim 1, wherein the spray nozzle is attached to a needle, which is housed within the rubber bellows.

3. The toy according to claim 1, wherein the check valve vessel is connected, via luer lock fittings and fluid tubing, to the fluid-filled canister, which contains a pressurizable fluid, luer lock check valve, and a rubber piston.

4. The toy according to claim 3, wherein the fluid-filled canister is attached to the outer housing, which comprises of Schrader valve, the luer lock fittings, and the fluid tubing.

5. The toy according to claim 4, wherein the Schrader valve of the outer housing is attached, via air tubing of the pressurized air housing to a piercing needle or an inflation needle.

6. A method, using the toy according to claim 5, wherein the user inserts the fluid-filled canister by attaching the luer-lock check valve on the fluid filled canister to the luer-lock fittings found in the outer housing, and then inserting the other end of the fluid filled canister into a slot found in the housing to create an air-tight seal via a rubber O-ring affixed to the fluid filled canister, and finally closing a cover of the outer housing.

7. The method according to claim 6, wherein the pressurized air housing comprises a CO2 cartridge housing, the user rotates a bolt on the CO2 cartridge housing to advance a CO2 cartridge, mounted in the CO2 cartridge housing, further into a piercing needle valve containing the piercing needle to pierce a seal on the CO2 cartridge to allow CO2 to enter the fluid-filled canister via the air tubing and the Schrader valve, and advances the rubber piston in the fluid-filled canister, thereby pushing the fluid through the luer-lock fittings and the fluid tubing into the check valve vessel and halting at the small check valve.

8. The method according to claim 6, wherein the pressurized air housing comprises an air-pressure canister, the user attaches the air-pressure canister, that has been prefilled with air to an adequate pressure rating via a Schrader valve, by inserting the inflation needle found in the outer housing through the rubber valve found in the air-pressure canister and securing via magnets, thus allowing the air to escape and enter the fluid-filled canister via the air tubing and the Schrader valve, advancing the rubber piston in the fluid-filled canister, thereby pushing the fluid through the luer-lock fittings and the fluid tubing into the check valve vessel and halting at the small check valve.

9. The method, according to claims 7 or 8, wherein the user advances the needle towards the small check valve located in the check valve vessel by depressing the lever resting upon the user's palm and compressing the rubber bellows, thereby activating the geared-trigger system, and opening the small check valve, thus allowing the fluid to enter a needle cavity of the needle and exit into a single stream via the spray nozzle.

10. The method according to claim 9, wherein the user retracts the needle with the spring-back aid of the compressed rubber bellows and removal of pressure from the lever, thus reversing the action of the geared-trigger system, closing the small check valve, and halting further fluid flow.

11. The toy, according to claim 5, where one can modify the pressurized housing by removing it and utilizing an extra fluid-filled canister.

12. The toy, according to claim 5, where one can substitute the pressurized-air housing with a motorized air-pump to allow for infinite air-pressure.

* * * * *